US005151021A

United States Patent [19]

Fujiwara et al.

[11] Patent Number: 5,151,021

[45] Date of Patent: Sep. 29, 1992

[54] FLUID COMPRESSOR WITH ADJUSTABLE BEARING SUPPORT PLATE

[75] Inventors: Takayoshi Fujiwara, Kawasaki; Hisanori Honma, Yokohama, both of Japan

[73] Assignee: Kabushiki Kaisha Toshiba, Kawasaki, Japan

[21] Appl. No.: 828,246

[22] Filed: Jan. 30, 1992

[30] Foreign Application Priority Data

Mar. 8, 1991 [JP] Japan ..... 3-43180

[51] Int. Cl.[5] ..... F04B 39/00

[52] U.S. Cl. ..... 418/93; 418/94; 418/97; 418/220; 417/356

[58] Field of Search ..... 418/220, 93, 94, 97, 418/100; 417/356; 415/75

[56] References Cited

U.S. PATENT DOCUMENTS

| | | | |
|---|---|---|---|
| 2,401,189 | 5/1946 | Quiroz | 418/220 |
| 4,802,827 | 2/1989 | Fujiwara et al. | 417/356 |
| 4,871,304 | 10/1989 | Iida et al. | 418/220 |
| 4,872,820 | 10/1989 | Iida et al. | 418/220 |
| 4,875,842 | 10/1989 | Iida et al. | 418/220 |
| 4,902,205 | 2/1990 | DaCosta et al. | 418/94 |
| 5,062,778 | 11/1991 | Hattori et al. | 418/220 |

*Primary Examiner*—Richard A. Bertsch
*Assistant Examiner*—David L. Cavanaugh
*Attorney, Agent, or Firm*—Cushman, Darby & Cushman

[57] ABSTRACT

In a fluid compressor, a cylinder is arranged within a sealed casing. A piston having a spiral groove is placed within the cylinder. The piston is made eccentric to the cylinder such that part of the piston is put in contact with the inner peripheral surface of the cylinder. The piston and the cylinder are rotated relative to each other. A spiral blade is fitted in the spiral groove. The blade is put in contact with the inner peripheral surface of the cylinder, and forming a plurality of working chambers. The blade freely projects from and retreats in the groove. A fluid to be compressed is sucked in the working chambers. The compressed fluid is discharged from a discharge hole portion into the sealed casing. A support mechanism supports the cylinder and one of bearing members for supporting shaft portions of the piston. The support mechanism receives the lubricating oil mixed in the high-pressure compressed fluid discharged from the discharge hole portion. Accordingly, the lubricating oil dispersed from the discharge hole portion is not exhausted to the outside of the sealed casing through an exhaust pipe.

14 Claims, 6 Drawing Sheets

FLUID COMPRESSOR WITH ADJUSTABLE BEARING SUPPORT PLATE

BACKGROUND OF THE INVENTION

1. Field of the Invention

The present invention relates to a fluid compressor for compressing a refrigerant gas, which compressor is provided, for example, in a refrigerator.

2. Description of the Related Art

Conventionally, various types of compressors for compressing a refrigerant, for use in refrigerators, are known; for example, a reciprocal type compressor, a rotary type compressor, etc.

In these conventional compressors, structures of compressing units or driving units for driving crank shafts for transmitting torque to the compressing units are complex, and the number of parts is large.

In such a compressor, a check valve must be provided on the exhaust side in order to raise the compression efficiency. The difference in pressure between both sides of the check valve is very high. Thus, gas may leak from the check valve, and consequently the compression efficiency is low.

In order to achieve the above object, it is necessary to enhance the precision in dimensions of parts and the precision in assembly, resulting in an increase in manufacturing costs.

U.S. Pat. No. 4,871,304 discloses a fluid compressor wherein a rod is arranged eccentrically in the inside of a cylinder, a spiral groove is formed in an outer peripheral portion of the rod, and a spiral blade is slidably fitted in the groove such that the blade can freely enter and retreat from the groove.

The pitch of the blade decreases towards the discharge side of the fluid compressor. A high pressure is applied through a pressure introducing passage to the bottom space of the spiral groove in which the blade is fitted.

U.S. Pat. No. 4,872,820 discloses a fluid compressor having basically the same structure as the compressor of U.S. Pat. No. 4,871,304, wherein a spiral blade is inclined such that an outer peripheral portion of the blade faces the exhaust side.

U.S. Pat. No. 4,875,842 discloses a fluid compressor having basically the same structure as the compressor of U.S. Pat. No. 4,872,820, wherein one of bearings for supporting both ends of a cylinder and a rotor (piston) is supported so as to be movable in parallel to the axis of the cylinder and in the radial direction of the cylinder, but not to be rotatable.

In each of the above compressors, a compressed fluid is discharged into a sealed casing through a discharge passage formed in a bearing.

The compressed fluid filled in the sealed casing is exhausted through an exhaust pipe connected to the sealed casing. In the case where the exhaust pipe is connected to a refrigerator, the fluid is led to a condenser.

In the meantime, the compressed fluid discharged into the sealed casing through the discharge passage is mixed with lubricating oil which has been supplied to sliding portions for lubrication.

Since the lubricating oil is mixed in the compressed fluid, the lubricating oil is dispersed when it is discharged into the sealed casing.

The dispersed lubricating oil reaches the inner peripheral wall of the sealed casing, a motor unit, and the opening of the exhaust pipe connected to the sealed casing.

In particular, the lubricating oil dispersed at the opening of the exhaust pipe is exhausted to the outside of the sealed casing along with the compressed fluid Once the lubricating oil has been exhausted from the compressor, the lubricating oil does not easily return to the compressor.

In addition, if the lubricating oil is dispersed on the inner peripheral wall of the sealed casing and if part of the oil flows along the inner peripheral wall down to the vicinity of the opening of the exhaust pipe, the part of the oil may be sucked into the opening by the influence of the high-pressure compressed fluid within the sealed casing.

If this undesirable condition continues for a long time period, the quantity of the lubricating oil remaining in the sealed casing reduces and the quantity of oil to be supplied to sliding portions runs short, resulting in lack of smoothness.

SUMMARY OF THE INVENTION

The present invention has been made in consideration of the above problems, and its object is to provide a fluid compressor with a relatively simple structure, which prevents a lubricating oil from being exhausted to the outside of the sealed casing along with a compressed fluid, maintaining a predetermined amount of lubricating oil in the sealed casing, surely supplies the oil to sliding parts, and maintaining smooth movement of sliding parts for a long period of time.

In order to achieve this object, there is provided a fluid compressor comprising:

- a sealed casing at the bottom of which an oil reservoir for receiving a lubricating oil is formed;
- suction means, connected to the sealed casing, for guiding a fluid to be compressed into the sealed casing, and exhaust means for exhausting the fluid compressed to a high pressure in the sealed casing;
- a cylinder housed in the sealed casing and having first and second ends;
- compression means including a columnar rotary body having at least one spiral groove and shaft portions at both ends, said rotary body being housed in the cylinder and arranged along the axis of the cylinder eccentrically to the axis of the cylinder such that the rotary body is rotatable relative to the cylinder with part of the outer periphery of the rotary body put in contact with the inner peripheral surface of the cylinder, and a spiral blade fitted in the spiral groove so as to freely project from and retreat in the groove in the radial direction of the rotary body, said blade having an outer peripheral surface put in contact with the inner peripheral surface of the cylinder, thereby partitioning the space between the inner peripheral surface of the cylinder and the outer periphery surface of the rotary body into a plurality of working chambers;
- a suction passage for sucking the fluid from the suction means and supplying the fluid into a first one of the working chambers;
- a discharge passage for discharging the compressed high-pressure fluid from the last one of the working chambers into the inside of the sealed casing;
- a first bearing member inserted in an opening at said one end of the cylinder, and a second bearing member inserted in an opening at said second end of the cylinder, the second bearing member being situated closer to said exhaust means than the first bearing member, thereby rotatably supporting said cylinder and the shaft portions of the rotary body; and support means for supporting the second bearing member and preventing the lubricating oil mixed in the high-pressure fluid and dispersed from the discharge passage from reaching the exhaust means.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

FIGS. 1 to 9D show a fluid compressor according to an embodiment of the present invention, in which FIG. 1 is a cross-sectional view of the overall structure of the fluid compressor;

FIG. 2 is a side view of a piston;

FIG. 3 is a side view of a blade;

FIG. 5 is a cross-sectional view of a support mechanism;

FIGS. 9 A to 9D illustrate the operation of the torque transmitting mechanism;

FIG. 1 shows a fluid compressor for compressing a refrigerant gas according to an embodiment of the invention, the fluid compressor constituting a part of a refrigerator.

Figure 1:
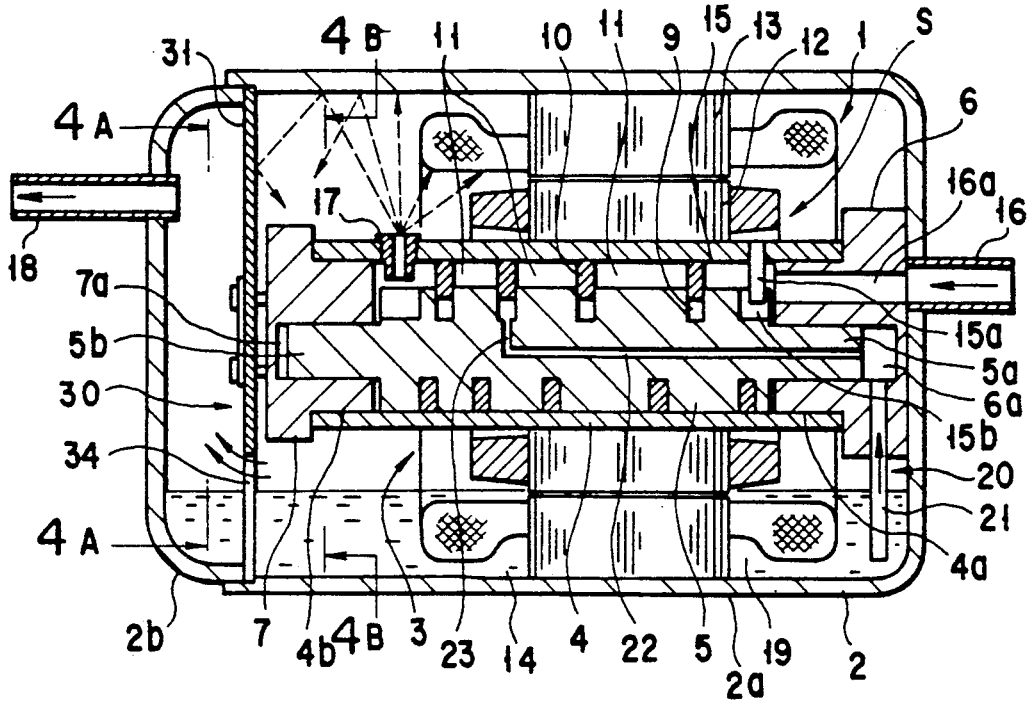

A motor unit 1 and a compressor unit 3 serving as compressing means are housed in a sealed casing 2. The sealed casing 2 has a circular cross section. The casing 2 comprises a casing body 2*a* having one end closed and the other end opened, and a cover casing 2*b*.

The compressor unit 3 comprises a cylinder 4 having both axial ends opened, a rotary body or piston 5 situated within the cylinder 4, and a blade 10 wound around the piston 5.

The cylinder 4 has a first end 4*a* at the right-side opening (in FIG. 1). A main bearing 6 or a first bearing member is inserted into the first end 4*a*.

The cylinder 4 has a second end 4*b* at the left-side opening, into which a sub-bearing 7 or a second bearing member is inserted.

The cylinder 4 is rotatably supported by the main bearing 6 and sub-bearing 7, and the openings at both ends 4*a* and 4*b* are sealed to prevent gas leakage.

The piston 5 has shaft portions 5*a* and 5*b* at both ends. The shaft portions 5*a* and 5*b* are rotatably supported in support holes 6*a* and 7*a* formed in the main bearing 6 and sub-bearing 7. The support holes 6*a* and 7*a* are situated eccentric to the center axes of the bearings.

The axis of the piston 5 is parallel to that of the cylinder 4. The center of piston 5 is eccentric to the center of the cylinder 4. Part of the peripheral surface of the piston 5 is put in contact with the inner peripheral surface of the cylinder 4.

The main bearing 6 is fixed on the inner wall on one side of the sealed casing 2. The sub-bearing 7 is supported by support means or support mechanism 30 provided on the other side of the sealed casing 2.

Figure 2:
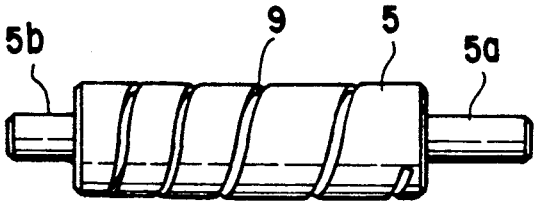

As is shown in FIGS. 1 and 2, the piston 5 is provided with a spiral groove 9 extending between both ends of the piston 5. The groove 9 has a pitch decreasing from the right to the left (in FIG. 1), i.e. from the shaft (5*a*) side to the shaft (5*b*) side.

Figure 3:
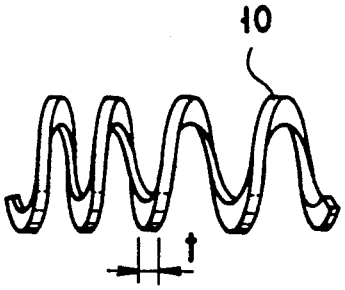

The spiral blade 10 is wound around the groove 9, so that the blade 10 may project from and retreat in the groove 9, as shown in FIGS. 1 to 3.

The blade 10 is made of, for example, a fluororesin, and has suitable elasticity. The thickness t of the blade 10 coincides with the width of the groove 9.

The entire blade 10 can freely project from and retreat in the groove 9 in the radial direction of the piston 5. The outer peripheral surface of the blade 10 is slidable while it is brought into close.contact wit the inner peripheral surface of the cylinder 4.

As is shown in FIG. 1, the space between the inner peripheral surface of the cylinder 4 and the periphery of the piston 5 is partitioned into a plurality of space portions by the blade 10. These space portions are called working chambers 11.

Each working chamber 11 extends along the blade 10 in a crescent shape between the contact portion between the inner peripheral surface of the cylinder 4 and the periphery of the piston 5.

The volumes of the working chambers 11 are gradually decreased from the first end 4*a* of the cylinder 4 to the second end 4*b*, in accordance with the pitch of the spiral groove 9.

A rotor 12 is mounted on the outer peripheral wall of the cylinder 4. A gap is provided between the rotor 12 and a stator 13 mounted on the sealed casing 2.

The rotor 12 and stator 13 constitute the motor unit 1.

A torque transmission mechanism 15 is provided on the first end (4*a*) side of the cylinder 4. The torque transmission mechanism 15 and motor unit 1 constitute drive means S.

The torque transmission mechanism 15 comprises an engaging pin 15*a* projecting from the inner peripheral wall of the cylinder 4, and an engaging groove 15*b* formed in the corresponding peripheral surface of the piston 5. The pin 15*a* is engaged in the groove 15*b*.

When power is supplied to the motor unit 1, the cylinder 4 is rotated and the engaging pin 15 rotates the piston 5 along with the groove 15*b*.

Specifically, the motor unit 1 rotates the cylinder 4 and piston 5 via the torque transmission mechanism 15, relative to and in synchronous with each other.

The main bearing 6 is provided with a suction hole 16*a* or a suction passage extending along the axis of the cylinder 4.

One end of the suction hole 16*a* is open to the inside of the first end 4*a* of the cylinder 4. The other end communicates with a suction pipe 16 or suction means which penetrates the sealed casing 2. The suction pipe 16 communicates with an evaporator in a refrigeration cycle circuit (not shown).

The second end 4*b* of the cylinder 4 is provided with a discharge hole portion 17 or a discharge passage for allowing the working chamber 11 defined in the cylinder 4 to communicate with the inside of the sealed casing 2 or the outside of the cylinder 4.

Exhaust means or an exhaust pipe 18 communicating with a condenser in the refrigeration cycle circuit (not shown).

The sub-bearing 7 is situated closer to the exhaust pipe 18 than the main bearing 6.

The support mechanism 30 for supporting the sub-bearing 7 is interposed between the opening of the exhaust pipe 18 and the discharge hole portion 17.

An oil reservoir 19 for receiving a lubricating oil is formed at the inner bottom portion of the sealed casing 2.

The lubricating oil in the oil reservoir 19 is sucked by an oil supply mechanism 20 or oil supply means and is supplied into the spiral groove 9.

The oil supply mechanism 20 is constituted by an oil suck pipe 21, an oil passage 22 and an oil supply hole 23.

An upper end portion of the oil suck pipe 21 is provided in the main bearing 6, and the upper end portion is open to the space defined between the support hole 6*a* and the end face of the shaft portion 5*a* of the piston 5.

The lower end portion of the oil suction pipe 21 is immersed in the lubricating oil in the oil reservoir 19.

The oil passage 22 is a fine hole extending along the axis of the piston 5 from the end face of the shaft portion 5*a* of piston 5 to a point between the end face of the shaft portion 5*a* and the other shaft portion 5*b*.

The oil supply hole 23 makes the end portion of the oil passage 22 communicate with part of the bottom of the spiral groove 9.

The support mechanism 30 will now be described.

As is shown in FIGS. 4 to 7, the support mechanism 30 comprises a thin-plate-shaped support disc 31, a slide metal fixing 33 engaged with the support disc 31, and a pair of pins 32 projecting from the end face of the sub-bearing 7 and engaged with the slide metal fixing 33.

A notch 34 is formed in the lower part of the support disc 31. A rectangular engaging hole 35, extending in a first direction or horizontal direction, is formed at a center area of the support disc 31.

The horizontal dimension of the slide metal fixing 33 is smaller than that of the engaging hole 35. The metal fixing 33 has a rectangular shape.

The slide metal fixing 33 has slide grooves 33*a* along the upper and lower edges on one side of the metal fixing 33. The grooves 33*a* are engaged with upper and lower edges of the engaging hole 35. The slide metal fixing 33 is slidable horizontally.

The slide metal fixing 33 has a pair of guide elongated holes 36 extending in parallel in a second direction perpendicular to the first direction.

The pins 32 are inserted in the holes 36 so as to be vertically slidable.

Figure 4A:
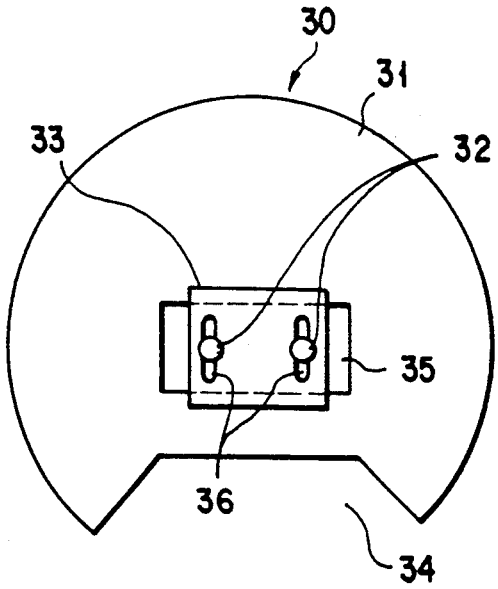
FIG. 4A is a cross-sectional view taken along line A—A in FIG. 1.
Figure 4B:
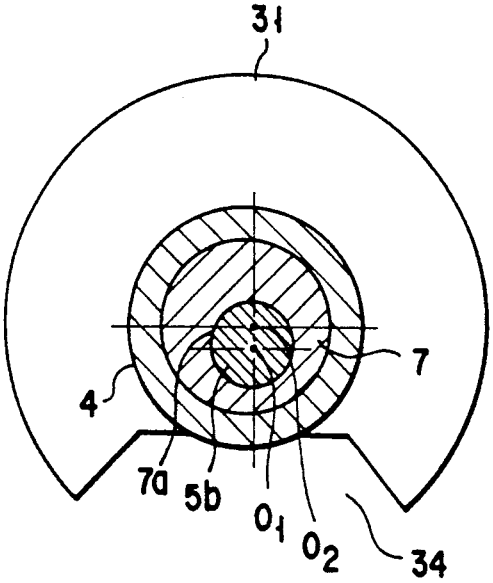
FIG. 4B is a cross-sectional view taken along line B—B in FIG. 1.
Figure 5:
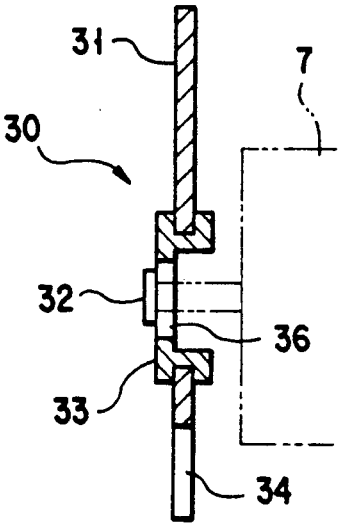
Figure 6A:
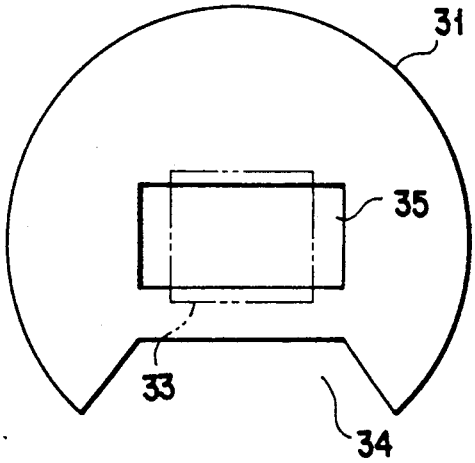
FIG. 6A is a front view of a support disc.
Figure 6B:
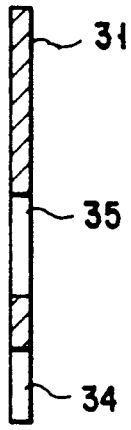
FIG. 6B is a cross-sectional view of the support disc.

In this manner, the support mechanism 30 is constructed. As shown in FIG. 4B, while the sub-bearing 7 is supported, the support hole 7*a* of the sub-bearing 7 is concentric with the axis $O_1$ of the shaft portion 5*b* of the piston 5, and the axis $O_1$ is eccentric to the axis $O_2$.

Figure 7A:
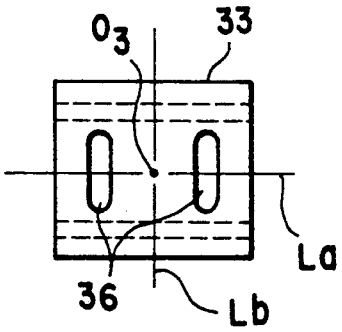
FIG. 7A is a front view of a slide metal fixing.
Figure 7B:
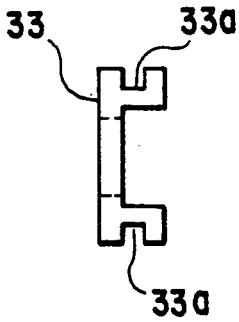
FIG. 7B is a side view of the slide metal fixing.
Figure 8A:
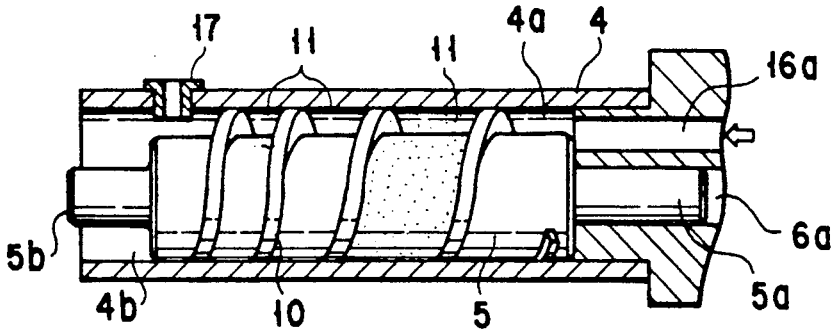
FIGS. 8A to FIG. 8D illustrate the compressing process of the refrigerant gas.
Figure 8B:
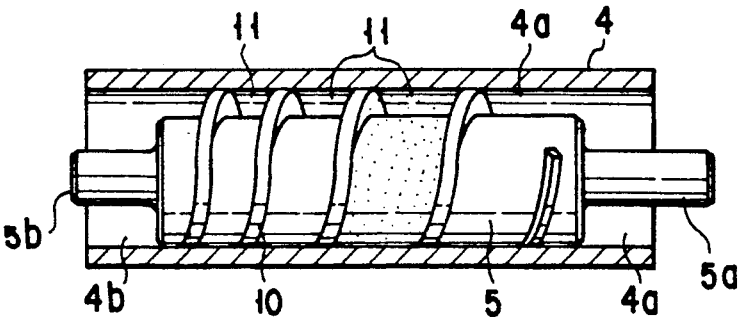
Figure 8C:
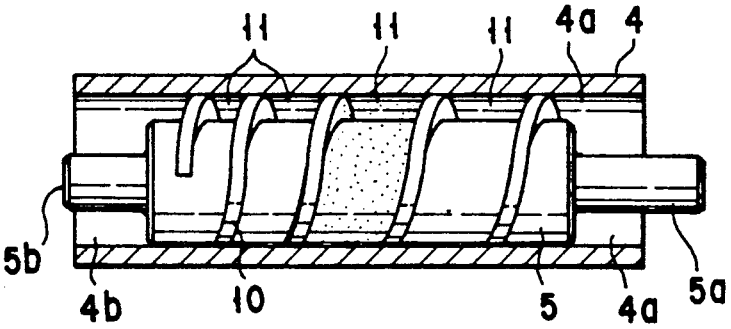
Figure 8D:
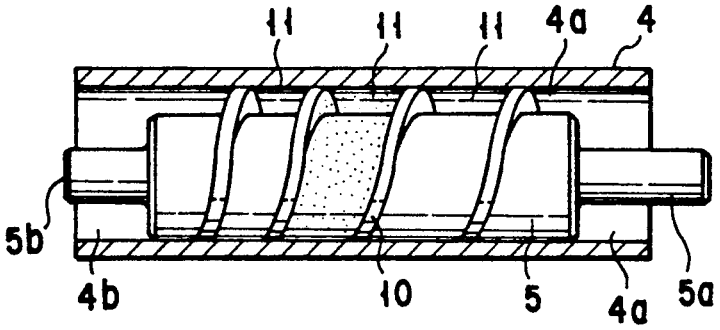
Figure 9A:
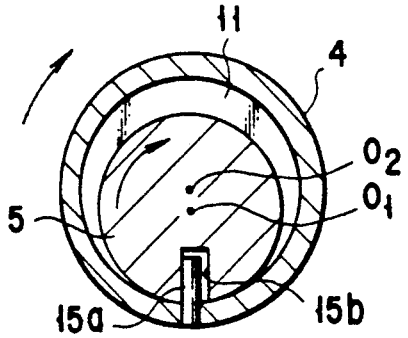
Figure 9B:
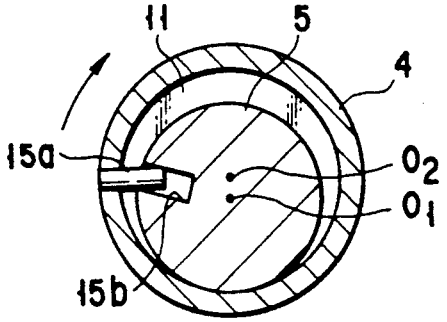
Figure 9C:
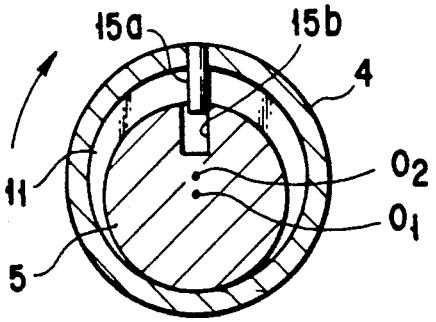
Figure 9D:
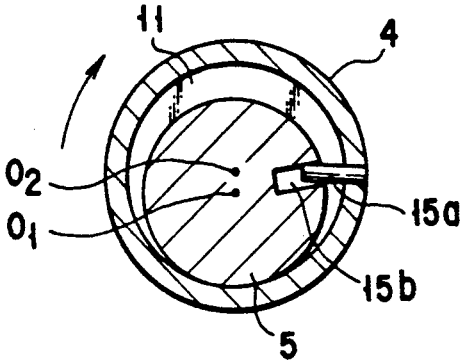

As is shown in FIG. 7A, a center axis $L_a$ connecting the slide grooves 33*a* of the slide metal fixing 33 intersects at right angles with a center axis $L_b$ connecting the guide elongated holes 36. The intersection $O_3$ coincides with the axis $O_1$ of the shaft portion 5*b* of the piston 5.

Referring to FIG. 1, the diameter of the support disc 31 is equal to the outer diameter of the cover casing 2*b* of sealed casing 2. The peripheral edge of the disc 31 is clamped and fixed between the end portion of the casing body 2*a* and the end portion of the cover casing 2*b*.

The location where the support disc 31 is between the discharge hole portion 17 formed in the cylinder 4 and the area where the exhaust pipe 18 is connected. The support disc 31, excluding the notch 34, partitions the inside of the sealed casing 2.

The upper edge of the notch 34 formed in the support disc 31 is sufficiently higher than the level of the lubricating oil in the oil reservoir 19. Thus, a space is always provided between the liquid surface of the lubricating oil and the upper edge of notch 34.

The operation of the fluid compressor having the above structure will now be described.

When power is supplied to the motor unit 1, the rotor 12 starts to rotate, and also the cylinder 4 integral with the rotor 12 rotates.

As is shown in FIGS. 9A to 9D, the torque of the cylinder 4 is transmitted to the piston 5 via the engaging pin 15*a* and the engaging groove 15*b*. The piston 5 is rotated relatively, with part of the outer periphery of the piston 5 remaining in contact with the inner periphery of the cylinder 4.

In the figures, the blade 10 (not shown) rotates integrally with the piston 5, and the outer peripheral surface of the blade 10 rotates while contacting the inner peripheral surface of the cylinder 4.

The blade 10 gradually retreats in the groove 9 as it approaches the contact portion between the periphery of the piston 5 and the inner peripheral surface of the cylinder 4, and gradually projects from the groove 9 as it goes away from the contact portion.

In this way, when the compressor unit 3 operates, a refrigerant gas to be compressed is sucked from the evaporator into the opening at the first end 4*a* of the cylinder 4 through the suction pipe 16 and suction hole 16*a*. The gas is guided into the first one of the working chambers 11.

As is illustrated in FIGS. 8A to 8D, the refrigerant gas is sequentially transferred to the second end (4*b*)-side working chamber 11, while it is confined in the chambers 11, in accordance with the rotation of the piston 5.

Since the volumes of the working chambers 11 are gradually reduced from the first end (4*a*) side to the second end (4*b*) side of the cylinder 4, the gas is gradually compressed while being transferred to the second end (4*b*) side.

The pressure of the compressed gas is raised to a predetermined value in the last working chamber 11 on the second end (4*b*) side and is discharged into the inside space of the sealed casing 2 through the discharge hole portion 17.

As is shown in FIG. 1, the inside of the sealed casing 2 is kept at high pressure by the compression operation. By the influence of the pressure, the lubricating oil in the oil reservoir 19 is sucked up through the oil suction pipe 21.

The oil is guided through the oil passage 22 and supplied in the spiral groove 9 through the oil supply hole 23 formed at the end of the passage 22.

Since the blade 10 is freely slid in and out of the groove 9, the lubricating oil is supplied to sliding portions, thereby ensuring smooth movement of the blade 10.

In addition, the oil is supplied to slidable contact portions between the outer peripheral surface of the blade 10 and the inner peripheral surface of the cylinder 4, slidable contact portions between the support holes 6*a* and 7*a* and piston shaft portions 5*a* and 5*b*, and slidable contact portions between the cylinder 4 and the main and sub-bearings 6 and 7, thereby ensuring smooth movements.

By virtue of the pressure of the lubricating oil led to the groove 9, the blade 10 is always pressed on the inner peripheral surface of the cylinder 4, i.e. in the direction in which the blade 10 projects from the groove 9. Thus, the outer peripheral surface of the blade 10 is surely put in contact with the inner peripheral surface of the cylinder 4.

Since the blade 10 is rotated with its outer peripheral surface always put in contact with the inner peripheral surface of the cylinder 4, adjacent ones of working chambers 11 can be surely partitioned, and gas leakage between chambers 11 can be prevented. As a result, gas can be compressed efficiently.

Since the blade 10 is pressed on the inner peripheral surface of the cylinder 4, the blade 10 is kept in contact with the inner peripheral surface of the cylinder 4 and smoothly moves in the groove 9, even if the manufacture precision of parts, e.g. squareness of blade 10, is not high.

Part of the lubricating oil supplied to the sliding portions is mixed in the refrigerant gas in the working chambers 11 and is transferred along with the refrigerant gas.

When the refrigerant gas compressed to a predetermined pressure is discharged to the inside of the sealed casing 2 from the last working chamber 11 via the discharge hole portion 17, the lubricating oil mixed in the refrigerant gas, the pressure of which is also raised, is discharged to the inside of the sealed casing 2 via the discharge hole portion 17.

As is indicated by broken lines, the lubricating oil discharged from the discharge hole portion 17 is dispersed in various directions. The dispersed oil reaches the motor unit 1 and the inner peripheral wall of the sealed casing 2.

In addition, since the support disc 31 for supporting the support mechanism 30 is provided near the discharge hole portion 17, the lubricating oil reaches the disc 31 directly or after hitting on the inner peripheral wall of the sealed casing 2.

The lubricating oil hits on the inner peripheral wall of the sealed casing 2, the motor unit 1 and the support disc 31, and separates from the refrigerant gas.

The separated oil flows down from the location where it has separated, and finally reaches the oil reservoir 19. Thus, the oil is received by the reservoir 19.

Since the space is provided between the upper edge of the notch 34 of support disc 31 and the liquid surface of the lubricating oil, the pressurized refrigerant gas separated from the lubricating oil passes through the space.

The pressurized gas, which has passed through the space of notch 34, is guided from the inside of the sealed casing 2 through the exhaust pipe 18 to the external device or condenser.

The lubricating oil dispersed from the discharge hole portion 17 towards the exhaust pipe 18 hits on the support disc 31 and falls down. Thus, the oil does not reach the opening of the exhaust pipe 18 directly.

Accordingly, the lubricating oil is not exhausted from the sealed casing 2 through the exhaust pipe 18, along with the refrigerant gas passing through the space of notch 34.

The lubricating oil, after supplied to the sliding portions, is recovered in the oil reservoir 19. Thus, a sufficient amount of lubricating oil can be kept in the oil reservoir 19 for a long period of time.

A sufficient amount of lubricating oil is supplied to the sliding portions, and high smoothness of sliding movement is attained.

Since the support mechanism 30 is so constructed that the sub-bearing 7, cylinder 4 and piston 5 is freely movable horizontally and vertically, variations in precision of actual parts and of assembly of the compressor can be canceled, and a frictional loss due to the sub-bearing 7 can be prevented.

During the compression operation, the rotation of the sub-bearing 7 for supporting the cylinder 4 and piston 5 can be prevented, despite the relative rotation of the cylinder 4 and piston 5.

Figure 10:
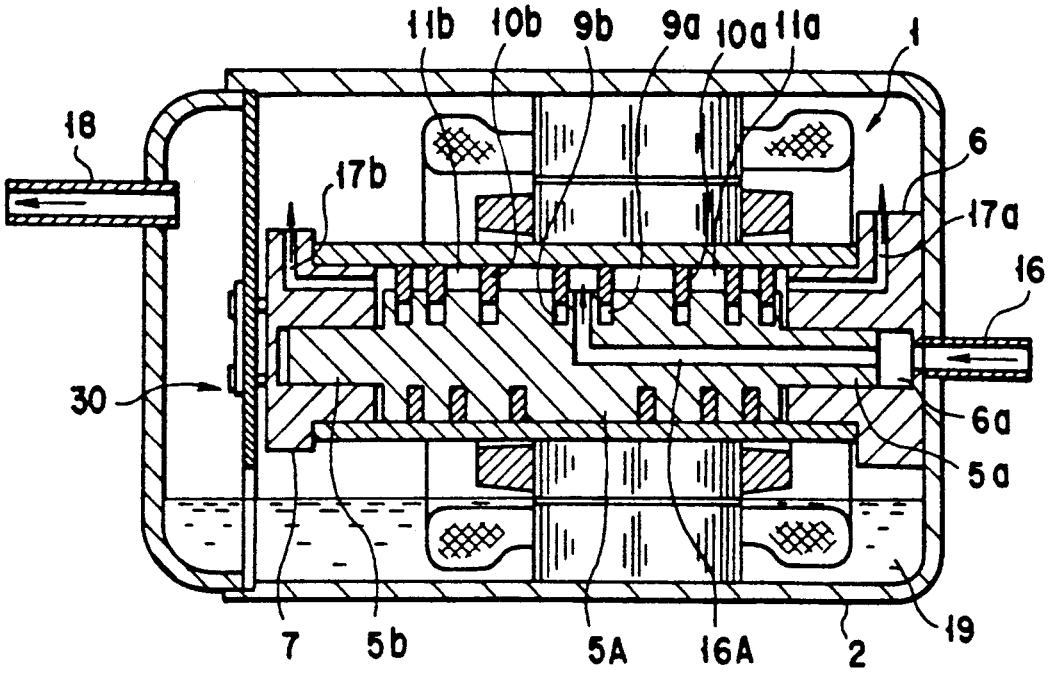
FIG. 10 is a side view of a fluid compressor according to another embodiment of the invention.

In the above embodiment, the fluid compressor having one spiral groove 9 in the peripheral surface of the piston 5 has been described. However, as shown in FIG. 10, it is possible to employ a piston 5A having two spiral grooves 9*a* and 9*b*.

In the case of this fluid compressor, the suction pipe 16 communicates with the support hole 6*a* of main bearing 6 and with a suction hole 16A extending from the end face of one shaft portion 5*a* of piston 5A to a middle portion of the peripheral surface of piston 5A.

The pitch of spiral grooves 9*a* and 9*b* decreases gradually from the point near the opening of the suction hole 16A towards the shaft portions 5*a* and 5*b*.

The relation between the piston 5A and cylinder 4 is similar with the above embodiment. Blades 10*a* and 10*b* having the same shape and function as in the above embodiment are fitted in the spiral grooves 9*a* and 9*b*. Thereby, working chambers 11*a* and 11*b* are defined by the blades 10*a* and 10*b*.

The main bearing 6 and sub-bearing 7 are provided, respectively, with discharge passages 17*a* and 17*b* opening at one end to the working chambers 11*a* and 11*b* and at the other end to the inside of the sealed casing 2.

The motor unit 1, sealed casing 2 with oil reservoir 19, support mechanism 30 and discharge pipe 18 have the same structures and functions as in the above embodiment.

Accordingly, in this fluid compressor, two compression systems performing compression simultaneously are constituted.

Figure 11:
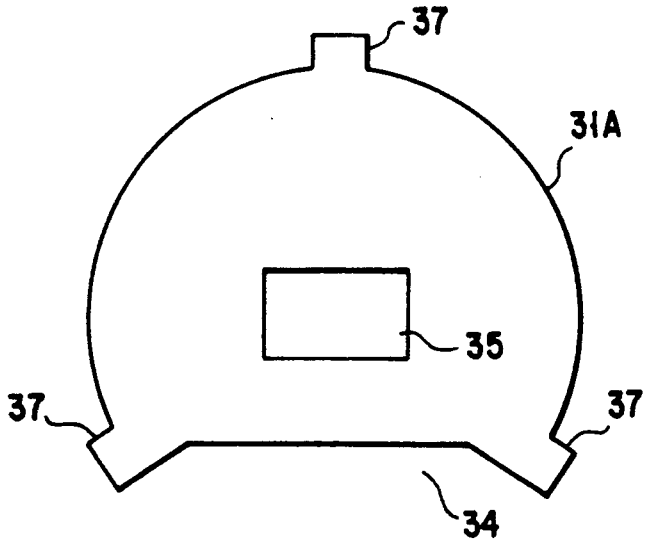
FIG. 11 is a front view of a support disc according to still another embodiment of the invention. DETAILED DESCRIPTION OF THE PREFERRED EMBODIMENTS Embodiments of the present invention will now be described with reference to the accompanying drawings.

In the above embodiment, the peripheral edge of the support disc 31 of support mechanism 30 is clamped between the end portion of casing body 2*a* and that of cover casing 2*b*. The manner of fixing the support disc 31 is not limited to this, and the example of FIG. 11 may be adopted.

The periphery of a support disc 31A is integrally provided with a plurality of projections 37 with predetermined intervals.

The diameter of the circular portion of support disc 31A is substantially equal to the diameter of the inner periphery of the cover casing 2*b*. The height and width of the projection 37 are matched with each of notches (not shown) newly provided along the edge of cover casing 2*b*.

The height of each projection 37 is equal to the depth of a stepped portion formed on the cover casing 2*b* for engagement.

The projections 37 are clamped between the edge portion of the casing body 2*a* and that of cover casing 2*b*, and are fitted in the notches.

Similarly with the above embodiment, the support disc 31*a* partitions the inside of the sealed casing 2 and supports the sub-bearing 7.

Accordingly, the slide metal fixing 33, etc., are displaced in accordance with the relative rotation of the cylinder 4 and piston 5. Even if force is exerted to rotate the support disc 31*a* by the influence of the displacement of the metal fixing 33, the disc 31*a* does not rotate since the projections 37 are engaged with the notches.

The support mechanism 30 may be fixed by using an adhesive, etc. after the sub-bearing 7 is assembled in a predetermined position in the sealed casing 2 and it is aligned.

In this case, the cylinder 4 and piston 5 are more stably supported on both sides.

The fluid compressor of this invention is applicable not only to refrigerators but also to other compressors for compression various fluids.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A fluid compressor comprising:

a sealed casing at the bottom of which an oil reservoir for receiving a lubricating oil is formed;

suction means, connected to the sealed casing, for guiding a fluid to be compressed into the sealed casing, and exhaust means for exhausting the fluid compressed to a high pressure in the sealed casing;

a cylinder housed in the sealed casing and having first and second ends;

compression means including a columnar rotary body having at least one spiral groove and shaft portions at both ends, said rotary body being housed in the cylinder and arranged along the axis of the cylinder eccentrically to the axis of the cylinder such that the rotary body is rotatable relative to the cylinder with part of the outer periphery of the rotary body put in contact with the inner peripheral surface of the cylinder, and a spiral blade fitted in the spiral groove so as to freely project from and retreat in the groove in the radial direction of the rotary body, said blade having an outer peripheral surface put in contact with the inner peripheral surface of the cylinder, thereby partitioning the space between the inner peripheral surface of the cylinder and the outer periphery surface of the rotary body into a plurality of working chambers;

a suction passage for sucking the fluid from the suction means and supplying the fluid into a first one of the working chambers;

a discharge passage for discharging the compressed high-pressure fluid from the last one of the working chambers into the inside of the sealed casing;

a first bearing member inserted in an opening at said one end of the cylinder, and a second bearing member inserted in an opening at said second end of the cylinder, the second bearing member being situated closer to said exhaust means than the first bearing member, thereby rotatably supporting said cylinder and the shaft portions of the rotary body; and support means for supporting the second bearing member and preventing the lubricating oil mixed in the high-pressure fluid and dispersed from the discharge passage from reaching the exhaust means.

2. The fluid compressor according to claim 1, wherein said suction means and said exhaust means are a suction pipe and an exhaust pipe connected to the sealed casing, and said support means is interposed between the discharge passage and the opening of the exhaust pipe.

3. The fluid compressor according to claim 2, wherein said support means is constituted by a plate body which partitions the inside of the sealed casing, and said support means supports the second bearing member slidably in a first direction and a second direction perpendicular to the first direction.

4. The fluid compressor according to claim 3, wherein said support means partitions the inside of the sealed casing, receives the lubricating oil dispersed from the discharge passage, and returns the oil to the oil reservoir, and said support means comprises a notch portion at a position higher than a level of the lubricating oil in the oil reservoir, and a support disc for passing the high-pressure fluid through a space between the surface of the lubricating oil and the upper edge of the notch.

5. The fluid compressor according to claim 4, wherein said support disc has at its center area an elongated engaging hole extending in the first direction, a slide metal fixing being engaged in the engaging hole slidably in the first direction, said slide metal fixing supporting the second bearing member slidably in the second direction.

6. The fluid compressor according to claim 5, wherein said slide metal fixing has at opposite edge portions slide grooves extending in the first direction of the engaging hole, and guide elongated holes extending in the second direction, and said second bearing member has pins slidably engaged in the guide elongated holes.

7. The fluid compressor according to claim 4, wherein said sealed casing comprises a casing body and a cover casing which seals the opening of the casing body, the peripheral edge of the support disc being clamped and fixed between the casing body and the cover casing.

8. The fluid compressor according to claim 7, wherein the peripheral edge of the support disc is provided with a plurality of projections clamped and fixed between the casing body and the cover casing, said projections serving a stoppers for stopping rotation of the support disc.

9. The fluid compressor according to claim 1, wherein said support means has adjusting means for adjusting the support position of the second bearing member in respect of the axis of the second bearing member, and has fixing means for fixing the support position after adjustment.

10. The fluid compressor according to claim 1, further comprising:

drive means including a motor unit for rotating the cylinder, and torque transmission means for transmitting the torque of the cylinder to the rotary body and rotating the rotary body in synchronism with the cylinder.

11. The fluid compressor according to claim 2, wherein said suction passage is formed in the first bearing member and said discharge passage is formed in at least one of the cylinder and the second bearing member.

12. The fluid compressor according to claim 1, wherein there are provided a plurality of said spiral grooves and a plurality of said blades fitted in the grooves.

13. The fluid compressor according to claim 1, further comprising:

oil supply means for sucking up the lubricating oil from the oil reservoir in accordance with the rotation of the cylinder and the rotary body, pressurizing the lubricating oil and supplying the oil to the space between the bottom of the spiral groove and the blade, and causing the pressurized lubricating oil to press the outer peripheral surface of the blade onto the inner peripheral surface of the cylinder.

14. A fluid compressor comprising:

a sealed casing at the bottom of which an oil reservoir for receiving a lubricating oil is formed;

a suction pipe, connected to the sealed casing, for guiding a fluid to be compressed into the sealed casing, and an exhaust pipe for exhausting the fluid compressed to a high pressure in the sealed casing;

a cylinder housed in the sealed casing and having first and second ends;

a columnar rotary body having at least one spiral groove and shaft portions at both ends, said rotary body being housed in the cylinder and arranged along the axis of the cylinder eccentrically to the axis of the cylinder such that the rotary body is rotatable relative to the cylinder with part of the rotary body put in contact with the inner peripheral surface of the cylinder;

a spiral blade fitted in the spiral groove so as to freely project from and retreat in the groove in the radial direction of the rotary body, said blade having an outer peripheral surface put in contact with the inner peripheral surface of the cylinder, thereby partitioning the space between the inner peripheral surface of the cylinder and the outer periphery surface of the rotary body into a plurality of working chambers;

a motor unit for rotating the cylinder;

torque transmitting means for transmitting the torque of the cylinder to the rotary body and rotating the rotary body in synchronism with the cylinder;

oil supply means for sucking up the lubricating oil from the oil reservoir in accordance with the rotation of the cylinder and the rotary body, pressurizing the lubricating oil and supplying the oil to the space between the bottom of the spiral groove and the blade, and causing the pressurized lubricating oil to press the outer peripheral surface of the blade onto the inner peripheral surface of the cylinder;

a first bearing member inserted in an opening at said one end of the cylinder, and a second bearing member inserted in an opening at said second end of the cylinder, thereby rotatably supporting said cylinder and the shaft portions of the rotary body; and a suction passage formed in the first bearing member for supplying the fluid introduced into the sealed casing from the suction pipe into a first one of the working chambers in accordance with the synchronize rotation of the rotary body and the cylinder;

a discharge passage, formed in at least one of the cylinder and the second bearing member, for discharging the compressed high-pressure fluid from the last one of the working chambers into the sealed casing, and dispersing the lubricating oil supplied to the space between the bottom of the spiral groove and the blade being dispersed into the sealed casing; and plate-like support means for supporting the second bearing member, the support means being situated between the area where the exhaust pipe is connected and the discharge passage to partition the inside of the sealed casing, said support means receiving the lubricating oil dispersed from the discharge passage, returning the oil to the oil reservoir, thereby preventing the oil from reaching the opening of the exhaust pipe.

* * * * *